United States Patent [19]

Baset

[11] 4,428,821

[45] Jan. 31, 1984

[54] OIL SHALE EXTRACTION PROCESS

[75] Inventor: Zeinab H. Baset, Seabrook, Tex.

[73] Assignee: Exxon Research & Engineering Company, Florham Park, N.J.

[21] Appl. No.: 438,996

[22] Filed: Nov. 4, 1982

[51] Int. Cl.[3] ..... C10G 1/04

[52] U.S. Cl. ..... 208/11 LE; 208/8 LE

[58] Field of Search ..... 208/11 LE, 8 LE

[56] References Cited

U.S. PATENT DOCUMENTS

| | | | |
|---|---|---|---|
| 700,489 | 4/1869 | Long et al. . | |
| 2,133,280 | 10/1938 | Burk . | |
| 4,108,760 | 8/1978 | Williams et al. | 208/11 LE |
| 4,156,463 | 5/1979 | Hall | 208/11 LE |
| 4,341,619 | 7/1982 | Poska | 208/11 LE |

FOREIGN PATENT DOCUMENTS

| | | | |
|---|---|---|---|
| 541829 | 1/1932 | Fed. Rep. of Germany . | |
| 1261707 | 1/1972 | United Kingdom | 208/11 LE |
| 1495722 | 12/1977 | United Kingdom | 208/11 LE |

*Primary Examiner*—Delbert E. Gantz
*Assistant Examiner*—A. Pal
*Attorney, Agent, or Firm*—Yale S. Finkle

[57] ABSTRACT

Hydrocarbon liquids are recovered from kerogen-containing oil shale by treating the oil shale with gaseous ammonia or a gaseous aliphatic amine prior to or during contact of the oil shale with an organic solvent. The hydrocarbon liquids thus extracted from the oil shale are then recovered from the solvent. The gaseous treatment step will normally take place at a temperature between about 500° F. and about 800° F. and at a pressure between about 200 psig and about 1000 psig. Preferably, the kerogen-containing oil shale will be treated with the ammonia or other gas prior to the extraction step.

18 Claims, 3 Drawing Figures

OIL SHALE EXTRACTION PROCESS

BACKGROUND OF THE INVENTION

This invention relates to a process for recovering organic material, primarily hydrocarbon liquids, from oil shale solids and is particularly concerned with a process for extracting the organic material from the oil shale at relatively mild temperatures.

Because of a dwindling supply of petroleum liquids from underground resevoirs, attention has recently been focused on the recovery of hydrocarbon liquids and gases from solids such as oil shale, coal, industrial and municipal solid wastes and the like. Work by both governmental agencies and private industry has demonstrated that the organic material in such solids can be converted with varying degrees of difficulty into volatile hydrocarbonaceous fluids such as combustible gases, motor fuels, heating and fuel oils, and various by-products which have value in chemical and petrochemical industries. In general, the more attractive of the recovery techniques previously proposed involve the heat treatment of such solids in a manner sufficient to distill or otherwise decompose the organic material into the above-mentioned volatile, hydrocarbonaceous products.

Oil shale is considered to be one of the best candidates of all carbon-containing materials for processing in such a retorting or pyrolysis scheme since it comprises a mixture of a minor amount of solid organic matter called kerogen and a major amount of mineral matter. The organic matter known as kerogen is a polymer which is virtually insoluble in organic solvents. Because of this insolubility, it has been virtually impossible in the past to extract the kerogen from the oil shale and therefore the application of heat via pyrolysis or retorting has had to be used. The retorting process is carried out at relatively high temperatures, normally between about 850° F. and about 1000° F., in order to cause the solid organic matter to undergo destructive pyrolysis and simultaneous conversion into liquid and light gaseous hydrocarbonaceous products with the remainder staying as a carbon-rich residue in the mineral matrix. Retorting, however, has several drawbacks. It is inefficient since only between about 60 and about 80 percent of the organic carbon is normally recovered, and at the high temperatures where retorting takes place, cracking reactions result in the formation of gas and undesirable carbon-rich residues which cannot be recovered. Furthermore, the process has a low thermal efficiency because of the high retorting temperatures required. Because of the disadvantages of the retorting process, it is highly desirable to be able to treat oil shales at lower temperatures to recover their organic matter in quantities comparable to those obtained via retorting.

SUMMARY OF THE INVENTION

The present invention provides a process for the extraction of oil shale solids which at least in part obviates the disadvantages of the processes referred to above. In accordance with the invention, it has now been found that relatively large amounts of organic material can be extracted with a liquid organic solvent from oil shale by treating the oil shale with a basic gas either simultaneously with or prior to contacting it with the solvent. The basic gas will have the chemical formula $$R_2-\underset{\underset{R_3}{|}}{N}-R_1$$

wherein $R_1$, $R_2$, and $R_3$ are selected from the group consisting of hydrogen atoms, and aliphatic radicals having from one to about three carbon atoms. Preferably, the basic gas will be ammonia or a short-chain aliphatic amine such as methyl amine or dimethyl amine. Normally, the treatment with the basic gas will take place at a temperature between about 500° F. and about 800° F., and at a pressure between about 200 psig and about 1000 psig. Laboratory studies indicate that carbon conversions similar to those obtained by pyrolyzing oil shale at about 930° F. can be obtained by utilizing gaseous ammonia in the process of the invention at a temperature of about 650° F. Laboratory studies further indicate that when ammonia is used as the basic treat gas, the total organic carbon conversion is at an optimum when the ammonia-to-shale ratio ranges between about 0.2 and about 0.7.

The process of the invention provides a relatively low temperature process for recovering hydrocarbon liquids from oil shale which is simple and does not require the use of the large amounts of energy required in high temperature processes. Thus, the process of the invention may provide a method of producing synthetic fuels from oil shale at a cost competitive with the cost of imported petroleum.

DESCRIPTION OF THE PREFERRED EMBODIMENTS

Figure 1:
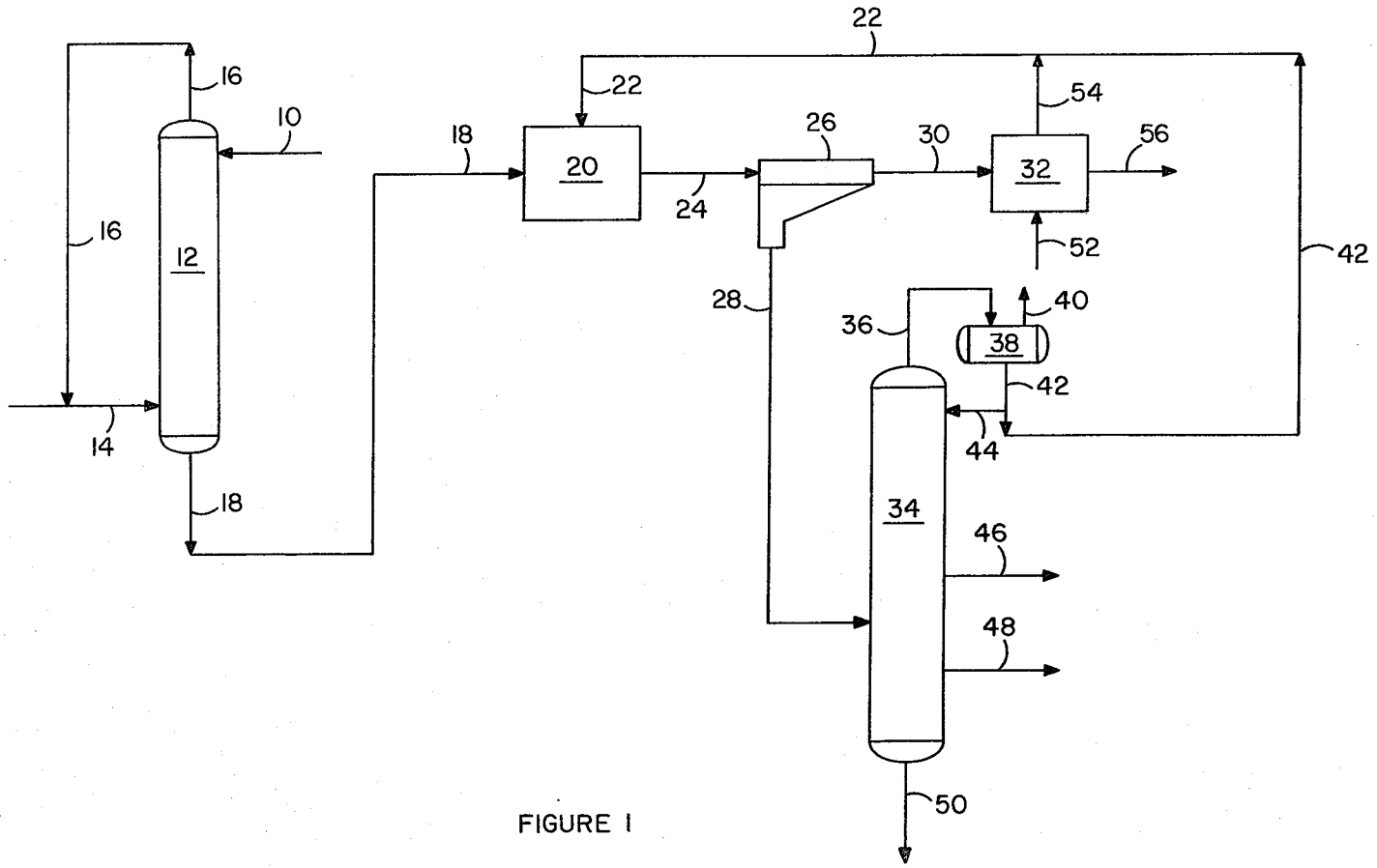
FIG. 1 in the drawing is a schematic flow diagram of a process for recovering liquid hydrocarbons from oil shale solids carried out in accordance with the invention.

In the process shown in FIG. 1, oil shale solids are introduced into fluidized bed contactor or similar vessel 12 through line 10 from a preparation plant, not shown, in which the oil shale is crushed, dried and screened or from a storage facility which does not appear in the figure. To facilitate handling of the feed solids, the oil shale is introduced into the system in a finely divided state, normally less than about 8 mesh on the U.S. Sieve Series Scale.

The oil shale solids introduced into the top of contactor 12 are passed downwardly through the vessel in contact with gaseous ammonia introduced into the bottom of the contactor through line 14. It will be understood that although ammonia is used in the process depicted in FIG. 1, any basic aliphatic amine having a formula of $$R_2-\underset{\underset{R_3}{|}}{N}-R_1$$

where $R_1$, $R_2$ and $R_3$ may be hydrogen atoms or aliphatic radicals having from one to about three carbon atoms may be used. Examples of such basic gases include methyl amine, dimethyl amine, trimethyl amine, and like. In general, a sufficient amount of ammonia or other basic gas is introduced into contactor 12 so that the gas to oil shale weight ratio is between about 0.1 and about 1.0 preferably between about 0.2 and about 0.7.

The temperature in contactor 12 will normally range between about 500° F. and about 800° F., preferably between about 530° F. and about 700° F., and most preferably between about 550° F. and about 650° F. The pressure in the contactor will normally be above atmospheric pressure and will generally range between about 200 psig and about 1000 psig, preferably between about 300 psig and about 600 psig. In no case will the pressure in the contactor be greater than the critical pressure of the ammonia or other treat gas used. The residence time in contractor 12 will normally range between about 20 minutes and about 180 minutes, preferably between about 60 minutes and about 90 minutes, and will decrease as the temperature in the contactor increases.

The temperature in the contactor will normally be maintained at a level such that virtually no cracking of the kerogen in the oil shale will take place. Because of this, the ammonia exiting the top of the contactor through line 16 will be relatively pure and can be recycled to the contractor through line 14. The ammonia-treated oil shale is removed from the contactor through line 18 and passed to extraction zone 20. Here, the pretreated oil shale particles are contacted, preferably in a multistage countercurrent extraction system, with an organic solvent or mixture of such solvents introduced into the extraction zone through line 22. In general, any organic solvent or mixture of solvents can be employed. Examples of suitable solvents include methylene bromide, perchloroethylene, chloroform, diesel oil, xylene, kerosene, gasoline, benzene, ethanol and light fractions of extracted organic material.

Normally, the kerogen in oil shale cannot be easily extracted with conventional organic solvents. Because of this, retorting of the oil shale at relatively high temperatures has heretofore been the only practical method of recovering the kerogen in the form of hydrocarbon oils. It has now been found that the kerogen in the oil shale can be rendered extractable with most conventional organic solvents by pretreating the oil shale with ammonia or similar basic gas in the group of aliphatic amines. The gaseous treatment can be carried out prior to or simultaneously with the solvent extraction step. If the gaseous treatment step is conducted prior to extraction, it can be carried out in the absence or presence of a hydrocarbon liquid. It is not presently understood why the treatment with gaseous ammonia or other gaseous amines renders the organic material in oil shale extractable with conventional solvents. It is believed, however, that the gaseous treating agent contributes to breaking the association between the organic material (kerogen) and the clay matrix which comprises the oil shale. This theory appears to be confirmed by data which indicates that high clay shales, those containing greater than about 20 percent by weight clay, tend to yield higher quantities of oil as opposed to shales that contain much less clay and much more carbonate in their mineral matrix. For this reason, shales containing between about 20 weight percent and about 80 weight percent, preferably between about 30 and about 60 weight percent, clay are preferred feeds to the process. Examples of such high clay shales can be found in Brazil, Australia, and the Eastern United States.

The extraction of the organic material from the oil shale in extraction zone 20 is normally carried out at relatively mild conditions as compared to the temperatures and pressures used in contactor 12. The extraction pressure will normally be atmospheric pressure, and the extraction temperature will normally range between about 100° F. and about 400° F. Under normal circumstances, the solvent will be at a temperature just below its boiling point since it will normally be a recycle stream produced by fractionating the liquid effluent from the extraction zone to separate and recover the extracted organic material from the solvent. Thus, the temperature in the extraction zone will normally depend upon the type of solvent which is employed to extract the organic material and the degree of cooling the solvent undergoes after it is removed from the fractionating tower and recycled to the extraction zone. The residence time of the solvent-solids slurry in extraction zone 20 will depend on the size of the particles fed to the extraction zone and the temperature at which the extraction is carried out. In general, more than about 35 weight percent of the organic material contained in the particles fed to the extraction zone will be extracted by the solvent under the conditions normally maintained in the extraction zone.

The effluent from extraction zone 20, which will consist of kerogen-depleted oil shale particles slurried in a liquid mixture of solvent and extracted organic material, is passed through line 24 to vibrating screen or similar separation device 26 where the kerogen-depleted oil shale particles are separated from the slurry liquid. The vibrating screen will be designed so only the liquid mixture of solvent and extracted hydrocarbons and very fine particles pass downward through line 28. The vast majority of the oil shale particles, which will contain entrained solvent, remain on top of the screen and are passed through line 30 into drying zone 32. It will be understood that in lieu of vibrating screen 26 shown in FIG. 1, other equipment can be used to separate the kerogen-depleted oil shale particles from the mixture of extracted hydrocarbons and solvent which is withdrawn from extraction zone 20. For example, cyclones, centrifuges, and other similar equipment can be used. The type of equipment that is used will normally depend upon the size of the oil shale particles in the slurry exiting extraction zone 20.

The mixture of solvent and extracted organic material withdrawn through line 28 from vibrating screen 26 along with fine particles of oil shale is passed to fractionator 34 where the solvent is separated from the extracted organic material and the fine oil shale particles. The solvent, which will generally have a boiling point lower than the majority of the constituents comprising the extracted organic material, will normally be removed overhead of the fractionator through line 36 along with gases and the lower boiling constituents of the extracted organic material. The fractionator overhead is cooled and passed to distillate drum 38 where the gases are taken off overhead through line 40 and passed to downstream units for further processing. The liquid, which will contain solvent and lighter constituents of the extracted organic material, is withdrawn from distillate drum 38 through line 42. A portion of this liquid may be returned as reflux to the upper portion of the fractionator through line 44. The remaining liquid is recycled through lines 42 and 22 to extraction zone 20.

One or more side streams boiling above the boiling range of the solvent are recovered from fractionator 34. In the particular unit shown in FIG. 1, a first side stream composed primarily of hydrocarbons boiling below about 700° F. is taken off through line 46. A second side stream composed primarily of hydrocarbons boiling below about 1000° F. is withdrawn from the fractionator through line 48. A bottoms fraction composed primarily of hydrocarbons boiling above about 1000° F. and fine particulate matter is withdrawn from the fractionator through line 50 and may be further processed to recover additional hydrocarbons or disposed of as landfill.

As previously mentioned, the particles of oil shale containing entrained solvent withdrawn from separation device 26 through line 30 are passed to drying zone 32. Here, the wet particles of oil shale are passed onto a grate and contacted with hot air or similar hot gas which is passed into the bottom of the drying zone through line 52. The hot air transfers heat to the wet oil shale particles thereby vaporizing the solvent. The vaporized solvent is withdrawn from the drying zone through line 54, condensed and passed into line 22 where it is mixed with the solvent recovered in fractionator 34. The combined solvent stream is then passed into extraction zone 20. Kerogen-depleted oil shale particles from which the solvent has been vaporized is withdrawn from the drying zone through line 56 and can be used as landfill or for other purposes. The hot air passed into drying zone 32 is preferably obtained by passing ambient air in indirect heat exchange with the hot liquid streams removed through lines 46 and 48 from fractionator 34.

It will be understood that although drying zone 32 is described as containing a grate which supports the wet oil shale particles while they are contacted with hot air, the drying zone may comprise a conveyor belt on which the wet particles are passed in contact with an atmosphere of gas hot enough to vaporize the solvent. Also, depending upon the solvent that is utilized, it may be desirable to use microwaves or infrared energy to supply the heat in the drying zone.

In the embodiment of the invention shown in FIG. 1 and described above, oil shale is pretreated with gaseous ammonia or other aliphatic amine, normally in the absence of a liquid phase, at elevated temperatures and pressures in a contacting zone and subsequently subjected to solvent extraction at milder conditions. It will be understood that the process of the invention is not limited to this particular method of treating the shale. For example, the extraction step and the gaseous treatment step can be carried out simultaneously in the same vessel. If this embodiment of the invention is utilized, the recycle solvent stream produced in fractionator 34 is passed directly to contactor 12, which will normally be a tank in which the ammonia or other treat gas is bubbled upwardly through a slurry of oil shale solids and recycle solvent. In such a case, extraction of the organic material from the oil shale will take place in the contactor. The slurry that is treated with the ammonia or other gas in contactor 12 is then passed directly to separation device 26 where the liquid portion of the slurry is removed from the solids.

The nature and objects of the invention are further illustrated by the results of laboratory tests. The first series of tests illustrates that the amount of organic material extracted from oil shale that has been pretreated with ammonia increases linearly with temperature. The second series of tests illustrates that the ammonia-to-shale weight ratio utilized in the pretreatment step is critical and that the use of large amounts of ammonia does not increase the amount of organic matter that is extracted from the pretreated oil shale.

Figure 2:
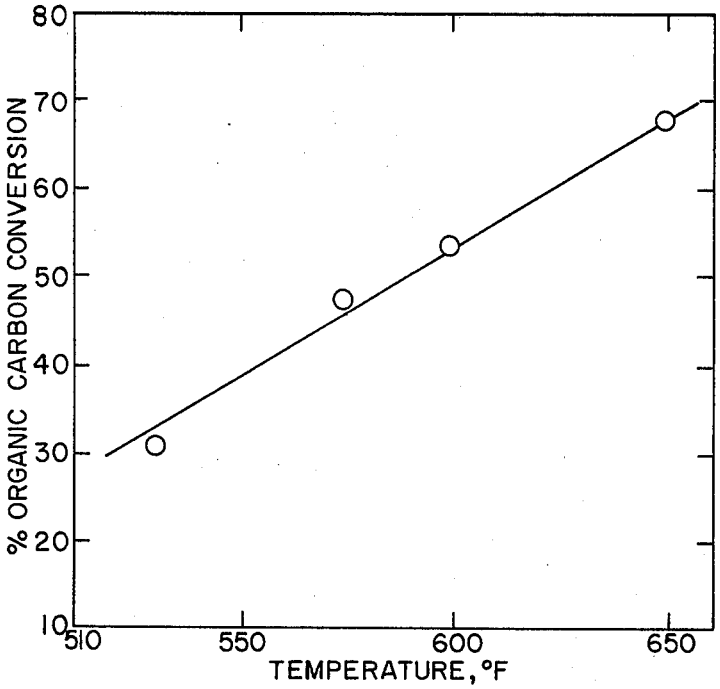
FIG. 2 is a plot which shows the percentage organic carbon conversion obtained when treating oil shale at various temperatures with gaseous ammonia prior to extracting the shale with a liquid organic solvent.

In the first series of tests, 10 grams of Rundle oil shale (Kerosene Creek seam) was placed in a 300 cc autoclave along with 11.6 grams of liquid ammonia (ammonia-to-shale weight ratio = 1.16). The autoclave was heated to a temperature between 530° F. and 650° F. to vaporize all of the ammonia and pressurize the autoclave. The autoclave was held at the desired temperature for between one and three hours. At the end of the desired time period, the heating of the autoclave was terminated and the pressure released. The treated shale was then subjected to a Soxhlet extraction in which a boiling mixture of benzene and ethanol was contacted with the shale. The solid residue from the Soxhlet extraction was then analyzed for organic carbon content and the percent organic carbon conversion was calculated based on the amount of carbon which was in the original shale fed to the autoclave. The results of these tests are shown in FIG. 2 and set forth below in Table 1 where they are compared with the standard Fischer Assay conversion.

TABLE 1

EFFECT OF AMMONIA TREATMENT TEMPERATURE ON ORGANIC CARBON CONVERSION

| Run No. | Temp. (°F.) | Residence Time (hrs.) | % Organic Carbon Conversion |
|---|---|---|---|
| 1 | 530 | 3 | 31.0 |
| 2 | 575 | 3 | 47.0 |
| 3 | 600 | 3 | 53.0 |
| 4 | 650 | 3 | 67.0 |
| 5 | 650 | 1 | 62.0 |

Fisher Assay at 932° F. → 64.0% Organic Carbon Conversion

As can be seen from runs 1 through 4 in Table 1 and from FIG. 2, the percent organic carbon conversion tends to increase linearly with the temperature of the ammonia treatment step when carried out at a constant residence time. This, of course, indicates that the amount of organic material extracted from the shale also increases linearly. A comparison of runs 4 and 5 in Table 1 shows that the organic carbon conversion decreases only slightly when the residence time is decreased by a factor of 3. Runs 4 and 5 in Table 1 also indicate that yields comparable to Fischer Assay yields at 932° F. can be obtained by treating the oil shale with ammonia prior to extraction. This data clearly shows then that yields equivalent to those obtained by retorting can be obtained by the process of the invention at much lower temperatures.

In the second series of tests, Rundle shale from Australia was treated with ammonia in an autoclave and subsequently extracted with a mixture of benzene and ethanol in the same general manner as described in the preceding series of tests except that the treatment temperature was always 530° F., the residence time was always 3 hours and the weight ratio of the amount of ammonia to shale used was varied. The pressure for this series of tests ranged between 390 psia and 430 psia. The results of these tests are set forth in FIG. 3.

Figure 3:
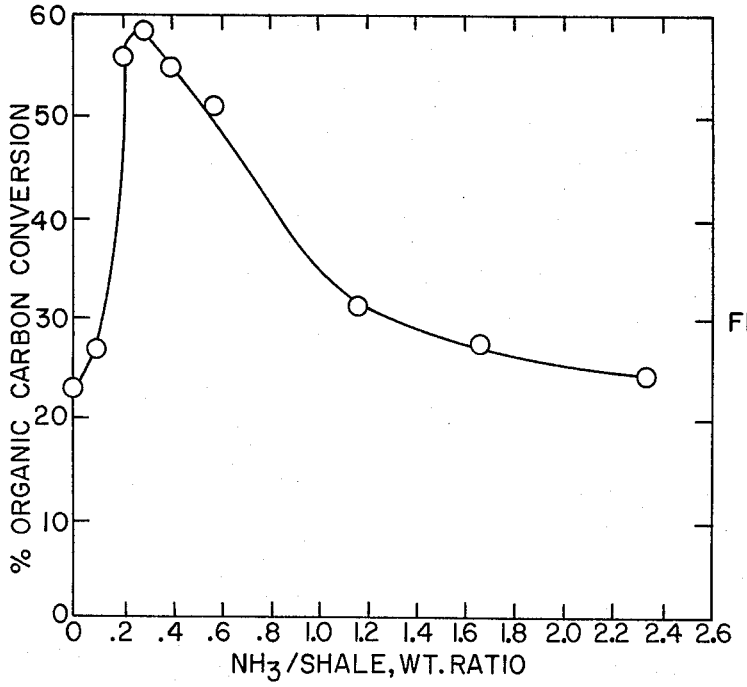
FIG. 3 is a plot illustrating that the ammonia-to-shale weight ratio is critical in obtaining optimum organic carbon conversions in the process of the invention.

It can be seen from FIG. 3 that the percent organic carbon conversion increases rapidly with only a small amount of ammonia present, reaches a peak at an ammonia-to-shale ratio of about 0.3, and then begins to decrease as the ammonia-to-shale ratio increases to above 2.0. The data in the figure indicate that the ammonia-to-shale weight ratio is critical and that it should preferably range from about 0.2 to about 0.7 for optimum extraction of the organic material from the shale.

It will be apparent from the foregoing that the process of the invention provides a method for recovering hydrocarbon liquids from kerogen-bearing oil shale without the need to utilize high temperature retorting. As a result, it is possible to significantly reduce the amount of heat that is normally required to produce such liquids in conventional processes thereby lowering the overall cost of the liquids.

What is claimed is:

1. In a process for extracting organic material from oil shale solids wherein said oil shale is contacted with a liquid organic solvent, the improvement which comprises treating said oil shale solids at a temperature between about 500° F. and about 800° F. with a basic gas having the formula

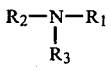

wherein $R_1$, $R_2$ and $R_3$ are selected from the group consisting of hydrogen atoms, and aliphatic radicals having from one to about three carbon atoms prior to or simultaneously with contacting said solids with said solvent, and wherein said oil shale solids are treated with said basic gas at a pressure below the critical pressure of said gas.

2. A process as defined by claim 1 wherein said basic gas comprises ammonia.

3. A process as defined by claim 1 wherein $R_1$ and $R_2$ are hydrogen atoms and $R_3$ is an aliphatic radical having one or two carbon atoms.

4. A process as defined by claim 3 wherein said basic gas comprises methyl amine.

5. A process as defined by claim 1 wherein $R_1$ is a hydrogen atom and $R_2$ and $R_3$ are aliphatic radicals having one or two carbon atoms.

6. A process as defined by claim 5 wherein said basic gas comprises dimethyl amine.

7. A process as defined by claim 1 wherein said oil shale solids are treated with said basic gas at a pressure between about 200 psig and about 1000 psig.

8. A process as defined by claim 1 wherein said oil shale solids are treated with said basic gas at a temperature between about 530° F. and about 700° F. and at a pressure between about 300 psig and about 600 psig.

9. A process as defined by claim 2 wherein the weight ratio of said ammonia to said oil shale in the treatment step ranges between about 0.2 and about 0.7.

10. A process as defined by claim 1 wherein said oil shale solids are treated with said basic gas for a period between about 20 minutes and about 180 minutes.

11. A process as defined by claim 1 wherein said oil shale solids are treated with said basic gas in the presence of said organic solvent.

12. A process for recovering hydrocarbon liquids from oil shale solids which comprises:

(a) contacting said oil shale solids with gaseous ammonia in a contacting zone at a temperature between about 500° F. and about 800° F. and at a pressure below the critical pressure of said ammonia to produce treated oil shale solids;

(b) contacting said treated oil shale solids from step (a) with an organic solvent in an extraction zone thereby extracting organic material from said treated solids; and (c) recovering the extracted organic material from said organic solvent as said hydrocarbon liquids.

13. A process as defined by claim 1 wherein said oil shale comprises a high clay content shale containing between about 20 weight percent and about 80 weight percent clay.

14. A process as defined by claim 12 wherein said oil shale comprises a high clay content shale containing between about 20 weight percent and about 80 weight percent clay.

15. A process as defined by claim 1 wherein said organic solvent is selected from the group consisting of methylene bromide, perchloroethylene, chloroform, diesel oil, xylene, kerosene, gasoline, benzene, ethanol and light fractions of the extracted organic material.

16. A process as defined by claim 12 wherein said organic solvent is selected from the group consisting of methylene bromide, perchloroethylene, chloroform, diesel oil, xylene, kerosene, gasoline, benzene, ethanol and light fractions of the extracted organic material.

17. A process as defined by claim 12 wherein step (b) is carried out at a temperature between about 100° F. and about 400° F. and at about atmospheric pressure.

18. A process as defined by claim 12 wherein said extracted organic material is recovered from said organic solvent by fractionation.

* * * * *